US011125062B2

(12) United States Patent
Hyland

(10) Patent No.: US 11,125,062 B2
(45) Date of Patent: Sep. 21, 2021

(54) FLOW MONITORING SYSTEM

(71) Applicant: CSignum Ltd., Bathgate (GB)

(72) Inventor: Brendan Peter Hyland, Livingston (GB)

(73) Assignee: CSignum Ltd., Bathgate (GB)

( * ) Notice: Subject to any disclaimer, the term of this patent is extended or adjusted under 35 U.S.C. 154(b) by 50 days.

(21) Appl. No.: 16/482,665

(22) PCT Filed: Feb. 1, 2018

(86) PCT No.: PCT/EP2018/052501
§ 371 (c)(1),
(2) Date: Jul. 31, 2019

(87) PCT Pub. No.: WO2018/141841
PCT Pub. Date: Aug. 9, 2018

(65) Prior Publication Data

US 2020/0011164 A1 Jan. 9, 2020

(30) Foreign Application Priority Data

Feb. 1, 2017 (GB) ..... 1701616

(51) Int. Cl.
*E21B 43/20* (2006.01)
*E21B 49/00* (2006.01)
(Continued)

(52) U.S. Cl.
CPC ..... *E21B 43/20* (2013.01); *E21B 47/07* (2020.05); *E21B 47/107* (2020.05); *E21B 49/008* (2013.01)

(58) Field of Classification Search
CPC ..... E21B 43/16; E21B 43/20; E21B 47/07; E21B 47/107; E21B 49/008
See application file for complete search history.

(56) References Cited

U.S. PATENT DOCUMENTS 3,145,772 A 8/1964 Huitt
2003/0131990 A1* 7/2003 Tubel ..... E21B 43/20 166/250.01

(Continued)

FOREIGN PATENT DOCUMENTS

WO WO 99/02819 A1 1/1999
WO WO 2014/168506 A1 10/2014

OTHER PUBLICATIONS

International Search Report and Written Opinion for International Application No. PCT/EP2018/052501 dated Sep. 20, 2019.

(Continued)

*Primary Examiner* — David Carroll
(74) *Attorney, Agent, or Firm* — Wolf, Greenfield & Sacks, P.C.

(57) ABSTRACT

A flow monitoring system comprising a first temperature sensor located at a reservoir input for measuring input temperature of a fluid in an enhance oil recovery system, a second temperature sensor located at a reservoir output for measuring temperature of output fluid and a processor in communication with the first temperature sensor and the second temperature sensor wherein the first temperature sensor and the second temperature sensor are operable to measure temperature data and communicate the measured data to the processor. The flow monitoring system further comprises a first flow monitor sensor located at the reservoir input for measuring flow of input fluid and the second flow monitoring sensor located at the reservoir output for measuring output fluid flow wherein the first and second flow monitoring sensors are operable to communicate measured flow data to the processor.

7 Claims, 2 Drawing Sheets

Figure 1:
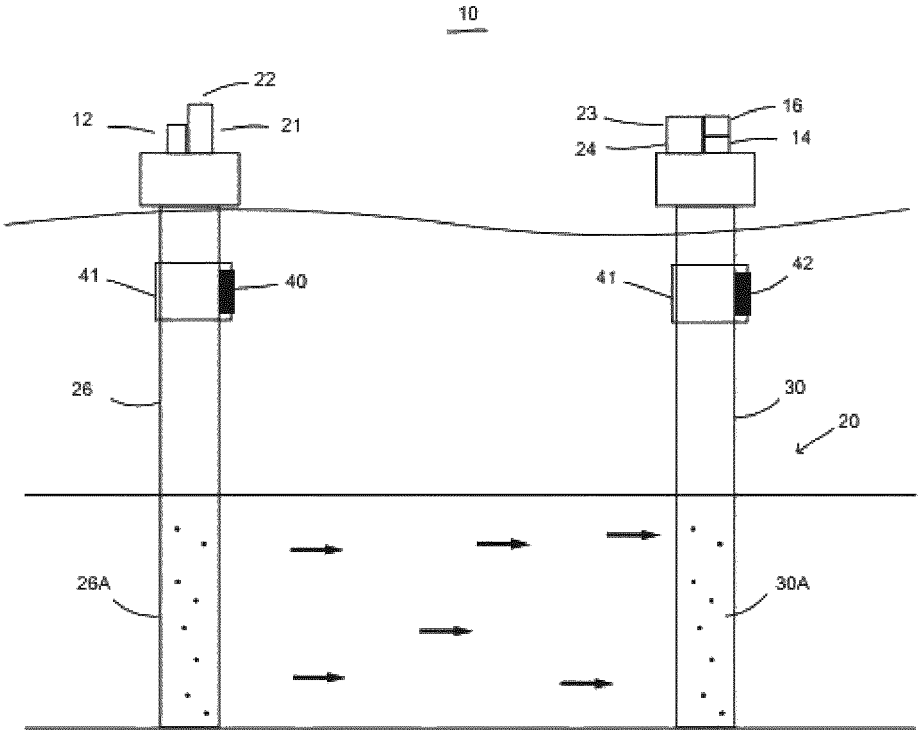

(51) Int. Cl.
*E21B 47/07* (2012.01)
*E21B 47/107* (2012.01)

(56) References Cited

U.S. PATENT DOCUMENTS

| | | | | |
|---|---|---|---|---|
| 2011/0158050 | A1* | 6/2011 | Merino | H01Q 1/04 367/81 |
| 2016/0063150 | A1* | 3/2016 | Safonov | E21B 43/16 703/10 |
| 2017/0009569 | A1 | 1/2017 | Manin et al. | |

OTHER PUBLICATIONS

International Preliminary Report on Patentability for International Application No. PCT/EP2018/052501 dated Sep. 26, 2019.

* cited by examiner

FLOW MONITORING SYSTEM

RELATED APPLICATIONS

This Application is a national stage filing under 35 U.S.C. 371 of International Patent Application Serial No. PCT/EP2018/052501, filed Feb. 1, 2018, entitled "FLOW MONITORING SYSTEM". Foreign priority benefits are claimed under 35 U.S.C. § 119(a)-(d) or 35 U.S.C. § 365(b) of British application number 1701616.3, filed Feb. 1, 2017. The entire contents of these applications are incorporated herein by reference in their entirety.

The invention relates to a flow monitoring system and, in particular, to a flow monitoring system for use in enhanced oil recovery processes.

In the downhole oil and gas industry, in many oil and gas fields, much of the easy to produce hydrocarbons have already been recovered. To extract as much hydrocarbon from an oil field as possible, enhanced oil recovery (EOR), or tertiary recovery, techniques have been developed which can see additional production from a partially depleted reservoir. These techniques can assist in optimising production, minimising corrosion and managing the lifespan of the reservoir.

One particular type of EOR involves injection of fluid, either liquid or gas, and typically water, into the reservoir with a view to the introduced fluid pushing additional oil within the reservoir to a production wellbore. The water injection is assisted by gas-lift and/or electrical submersible pumps and monitored with a topside flow monitoring arrangement. Water, or fluid, injection increases recovery of the crude oil in the reservoir by replenishing voidage/lost pressure or by sweeping oil towards the production wells.

However, issues can arise in that, in some circumstances, the injected fluid can drive across the reservoir and be extracted from the wellbore as opposed to driving the hydrocarbons into the wellbore. In addition, water injection at below target rates for prolonged periods will adversely impact output of the field. This can lead to well damage, locking in crude oil to the reservoir, and for shortening life expectancy of the oilfield. Topside flow monitoring has limited ability to instantly identify pollution of the output fluid occurring.

It is therefore an object of the present invention to provide a monitoring system able to determine if fluid injected into a reservoir is being drawn from the wellbore.

According a first aspect of the invention there is a flow monitoring system comprising a first temperature sensor located at a reservoir input for measuring input temperature of a fluid in an enhance oil recovery system, a second temperature sensor located at a reservoir output for measuring temperature of output fluid and a processor in communication with the first temperature sensor and the second temperature sensor wherein the first temperature sensor and the second temperature sensor are operable to measure temperature data and communicate the measured data to the processor.

By providing temperature sensors at the system input and the system output, it is possible for the temperature sensors to identify the temperature of the fluid input in to the reservoir and the temperature of the fluid output at the reservoir exit. This enables any discrepancies from an expected model to be identified.

Preferably, the processor is operable to act upon the measured input temperature and measured output temperature data to determine the relative temperature difference between input and output fluids. By monitoring the input temperature and output temperature and identifying the relative differences between the two, it is possible for the processor to determine the correlation between the relative difference in temperature and identify when injected fluid starts to be drawn from the wellbore.

The reservoir input may be the injection input.

The reservoir output may be the wellbore output.

Each sensor may be operable to enable wireless data communication. Use of wireless data communication within the network enables the system to communicate without need for subsea cabling. In addition, wireless communications allow effective and reliable real time control and communication between the system and a control base, for example such as surface-based operations.

Preferably the system further comprises a first flow monitor sensor located at a reservoir input for measuring flow of input fluid and the second flow monitoring sensor located at a reservoir output for measuring output fluid flow wherein the first and second flow monitoring sensors are operable to communicate measured flow data to the processor.

By incorporating flow monitoring sensors into the system, more data can be collected and a comparison of different measures can provide more valuable feedback. In addition, the flow monitoring sensors can provide data which gives a useful indication of a leak existing in the system.

Preferably temperature sensors and flow monitoring sensors may be battery powered allowing each component of the sensor network to operate independently.

Preferably the sensors have local processing means to optimise signal strength for data transmission to the processor. By optimising signal strength, the need for adjustment of sensors during deployment is avoided.

Figure 2:
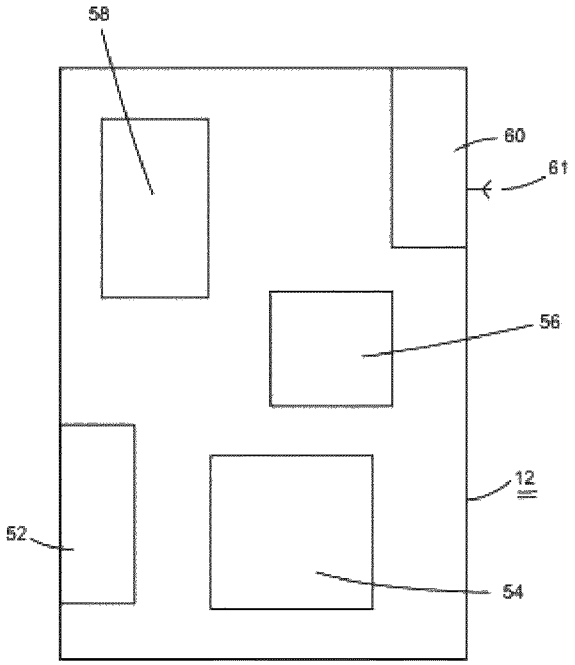

The present invention will now be described with reference to the following figures, by way of example only, in which:

FIG. 1 shows a cross section of an oil recovery system including a flow monitoring system of the present invention, and FIG. 2 shows a block diagram of a sensor unit for use in a monitoring system of FIG. 1.

With reference to FIG. 1, there is showing a monitoring system, generally referred to as reference numeral 10, arranged on an oil recovery system 20 which is implementing an enhanced oil recovery process.

The monitoring system comprises an input temperature sensor 12, and output temperature sensor 14 and a processor mechanism 16. The input temperature sensor 12 is arranged at the entrance 21 to an injection wellbore 22. The output temperature sensor 14 is arranged at the egress 23 to a production wellbore 24 and is co-located with processor 16. Processor 16 is able to receive data from sensor 12, 14 and carry out local processing which provides system characterisation thus enabling process optimisation.

The monitoring system 10, in this embodiment, retrofit flow monitor sensor units 40, 42 to input casing 26 and output casing 30 respectively. The retrofit flow meters 40,42 can be used to collect data which when transferred to the processor will characterise the water injection into the reservoir 28 and identify any deviations from reservoir model requirements. Once the water injection system 21 has been characterised, data collected by the flow meters can be optimised by adjustments to hydraulic subsea control valves (not shown). Data collected from the flow meters can also be acted upon to provide information enabling the monitor and management of leaks. The retrofit flow meter sensors 40, 42 can be ultrasonic flow meters and as these are deployed outside the pipe, pressure integrity within the pipe is not affected by the flow meter sensors 40, 42. It will be appreciated that the sensor units 40, 42 may also include or alternatively include, acoustic sensors are particularly useful in picking up multiphase flow providing a better idea of the occurrence of slugging at the multiphase flow caused by impedance such as slugs generates an acoustic noise output within the pipe. By contrast flow meters are of particular use for identifying laminar flow. It will be appreciated that either acoustic and ultrasonic flow meters or acoustic or ultrasonic flow meters may be used within the sensor units 40, 42.

Each retrofit sensor, in this case sensors 40, 42 may be secured to the casing 26 and 30 by magnetic clamps 41. However, it will be appreciated that any suitable securing method including, but not limited to clamps, straps or the like may be used. In each case the sensor unit will be arranged such that the sensors are positioned on the same side of the pipe.

Each of the temperature sensors 12, 14 and flow meters 40, 42 and processor 16 can be wirelessly enabled to allow wireless communication between the sensor units 12, 14 meter 40, 42 and processor 16. Wireless repeater nodes (not shown) can also be integrated into the monitoring system 10 to assist in ensuring wireless communications can occur over longer range distances by acting as an intermediate communication node. The wireless data communication system may use acoustic, radio or a hybrid acoustic and radio technique.

Data may be recovered from the processor 16 through wired, wireless data communications or a combination of the two allowing processed data to be provided to, for example surface vessels for monitoring. Temperature sensor in flow meters may be battery powered on each component of the system to work independently.

The sensors 12, 14, 40 and 42 may be arranged to include local processing to optimise signal strength for transmission of data thus avoiding the need for adjustment of sensors 12, 14, 40, 42 during deployment. Sensors 12, 14, 40, 42 can be arranged to have a duty cycle of one sample every six hours. However, it will be appreciated that the sample rate can be adjusted to match process model requirements.

During configuration and commissioning phase of installation, the system sample rate may be increased to allow a picture of performance of the overall system 20 to be built up quickly. During normal operations a lower rate of sampling can be used to assist in conserving battery life by lowering ongoing power consumption.

With reference to FIG. 2 there is shown a block diagram of a sensor unit, in this case sensor unit 12. The sensor unit 12 includes, in this case, a sensor 52, data logger 54, processor 56, battery 58, and transceiver 60 having an antenna 61. Sensor 52 senses data, in this case, it is a thermometer which senses temperature data, which is transmitted to data logger 54 and subsequently to processor 56 from where it may be transmitted by transceiver 60 to the processor 16. The integrated data logger 54 and local processor 56 can process locally collected data to produce a histogram of flow data showing multiple samples of sensed data. It will be appreciated that the sensor unit 14 will be formed with the same components as is shown for sensor unit 12 and flow monitor units 40, 42 will also share the same components as for sensor unit 12 with the sensor 52 comprising a flow meter.

In use fluid (not shown) is driven into input 21 of injection well 22. Temperature sensor 12 determines the temperature of the fluid as it is input into the system 10. The fluid passes through the casing 26 to perforated casing 26A which corresponds to the location of hydrocarbon reservoir 28. The fluid drives across reservoir 28 pushing hydrocarbon products to the perforated casing 30A, the hydrocarbon driven to casing 30A is then drawn up through casing 30 of production well 24. At the output 23 of the production well 24, output temperature sensor 14 is operable to determine the temperature of the fluid as it exits the wellbore 24. The measured data from sensors 12, 14 can then be acted upon by processor 16 to provide relative data of the temperatures such that correlation can be made between temperature variation of the fluid when injected into the system 20 and when fluid is being extracted from the wellbore 24. The measured data is able to be used to determine whether the driven hydrocarbons are being extracted or whether driven EOR fluid is being drawn from the reservoir instead.

The principle advantage of the invention is that the differential temperature data recorded between the sensors can be used to determine a correlation between such data, and the accompanying change in temperature, and the quantity of injection fluid which is being extracted from the accompanying wellbore.

Another advantage of the system is the management of water injection so optimise well reservoir output from the wellbore.

It will be appreciated to those killed in the art that various modifications may be made to the invention herein described without departing from the scope thereof. For example, only two temperature sensors 12, 14 and two flow monitoring sensors 40, 42 have been described with reference to accompanying drawings. However, the oil recovery system 20 may be more complex than that illustrated with plural wellbores and reservoirs interlinked and it will be appreciated that in such a case a complex array of multiple temperature sensors and flow monitoring sensors may be deployed. Sensor unit 12 is shown with only one sensor, a temperature sensor, but it will be appreciated the sensor unit may include any suitable or desirable sensor and indeed may include multiple sensors with the one housing or adjacent one another. In addition, the flow monitoring system has been described herein with reference to subsea oil and gas extraction wells however, it will be appreciated that such a monitoring system could also be deployed within fracking systems too.

The invention claimed is:

1. A flow monitoring system comprising:

a first temperature sensor located at a reservoir input, wherein the first temperature sensor is configured to measure an input temperature of an input fluid in an oil recovery system;

a second temperature sensor located at a reservoir output, wherein the second temperature sensor is configured to measure an output temperature of an output fluid; and a processor in communication with the first temperature sensor and the second temperature sensor, wherein the first temperature sensor and the second temperature sensor are configured to communicate measured temperature data to the processor, and the processor is configured to:

determine a relative temperature difference between the input fluid and the output fluid based on the input temperature measured by the first temperature sensor and the output temperature measured by the second temperature sensor, and determine, based on the relative temperature difference, whether the input fluid is being drawn from a reservoir.

2. The flow monitoring system as claimed in claim 1, wherein the reservoir input is in an injection input.

3. The flow monitoring system as claimed in claim 1, wherein the reservoir output is a wellbore output.

4. The flow monitoring system as claimed in claim 1, wherein each of the first temperature sensor and the second temperature sensor is operable to enable wireless data communication.

5. The flow monitoring system as claimed in claim 1, wherein the flow monitoring system further comprises a first flow monitor sensor located at the reservoir input for measuring flow of the input fluid and a second flow monitoring sensor located at the reservoir output for measuring flow of the output fluid, wherein the first and second flow monitoring sensors are operable to communicate measured flow data to the processor.

6. The flow monitoring system as claimed in claim 1, wherein each of the first temperature sensor and the second temperature sensor is battery powered.

7. The flow monitoring system as claimed in claim 1, wherein each of the first temperature sensor and the second temperature sensor has local processing means to optimize signal strength for data transmission to the processor.

* * * * *